United States Patent [19]

Egli et al.

[11] 4,146,179

[45] Mar. 27, 1979

[54] APPARATUS FOR SPRAYING OF DISPERSE SYSTEMS

[75] Inventors: Rene Egli, Sins; Hans-Rudolf Staub, Eggenwil, both of Switzerland

[73] Assignee: Lonza, Ltd., Gampel, Switzerland

[21] Appl. No.: 808,516

[22] Filed: Jun. 21, 1977

[30] Foreign Application Priority Data

Jun. 21, 1976 [CH] Switzerland ..... 007881/76
Feb. 24, 1977 [CH] Switzerland ..... 002304/77

[51] Int. Cl.[2] ..... B05B 15/02

[52] U.S. Cl. ..... 239/123; 137/614.11; 137/625.3; 222/148; 239/575

[58] Field of Search ..... 239/106, 114–118, 239/123, 125, 464, 574, 575, 583; 137/242, 243, 243.1, 244, 614.11, 625.3, 625.38; 222/148, 149

[56] References Cited

U.S. PATENT DOCUMENTS 1,486,685 3/1924 Reinhardt ..... 239/123 X

FOREIGN PATENT DOCUMENTS 569852 4/1924 France ..... 239/117
1009184 11/1965 United Kingdom ..... 239/525
1059690 2/1967 United Kingdom ..... 239/412
1140442 1/1969 United Kingdom ..... 239/525
1160957 8/1969 United Kingdom ..... 239/525
1359439 7/1974 United Kingdom ..... 239/296
1374200 11/1974 United Kingdom ..... 239/583

*Primary Examiner*—Robert B. Reeves
*Assistant Examiner*—Andres Kashnikow
*Attorney, Agent, or Firm*—Fisher, Christen & Sabol

[57] ABSTRACT

An apparatus for the spraying of a disperse system and which has a spray head with a hole-type nozzle. A plunger is present which is movably disposed inside the spray head and is shiftable in front of the aperture of the hole-type nozzle. A screen insert is present which is disposed in the spray head between the inlet for the disperse system and the hole-type nozzle. A scraper for the screen insert is present which is disposed between the inlet for the disperse system and the screen insert in such a manner that the scraper, upon movement of the plunger, sweeps the screen surface. An outlet, for the oversized particles scraped off of the screen surface, which is located between the inlet and the screen insert. A process for using the apparatus to spray a disperse system.

4 Claims, 4 Drawing Figures

FIG. I
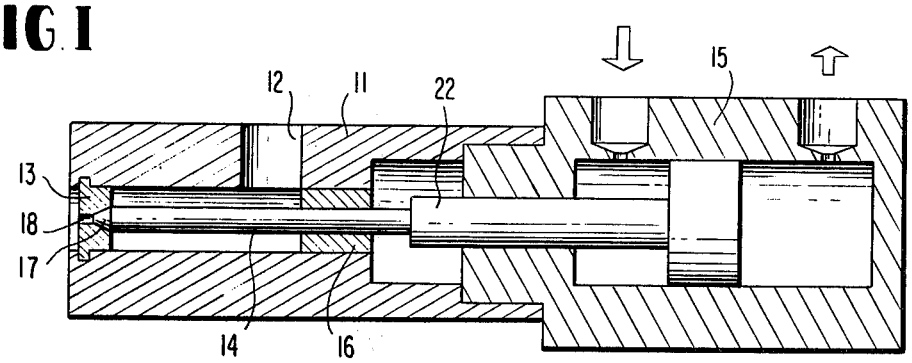
FIG. II
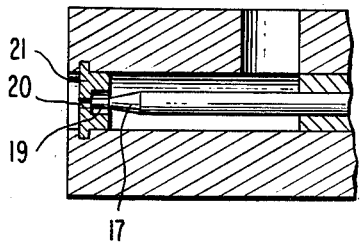
FIG. III
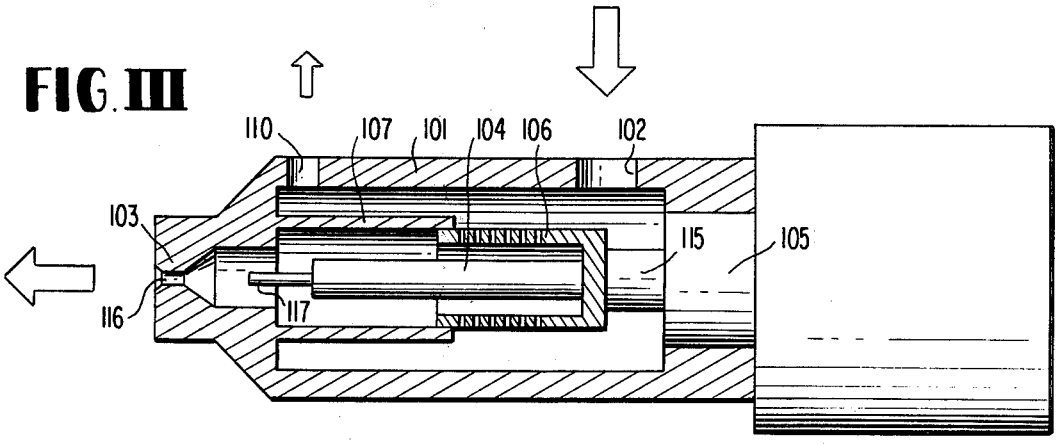
FIG. IV
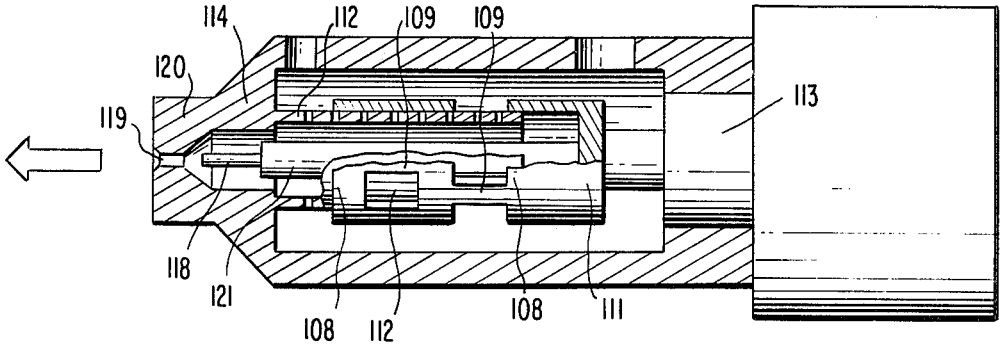

APPARATUS FOR SPRAYING OF DISPERSE SYSTEMS

FIELD OF THE INVENTION

This invention relates to an apparatus for spraying a disperse system and which has a apray head with a hole-type nozzle. This invention further relates to a process of using such apparatus.

BROAD DESCRIPTION OF THIS INVENTION

An object of this invention is to provide an apparatus for sparying a disperse system and which has a spray head with a hole-type nozzle. Another object of this invention is to provide a process for using such apparatus. Other objects and advantages of this invention are set out herein or are obvious herefrom to one ordinarily skilled in the art.

The objects and advantages of this invention are achieved by the apparatus and process of this invention.

The apparatus of this invention involves apparatus for the spraying of disperse systems containing a spray head with a hole-type nozzle. The apparatus includes a plunger disposed inside the spray head, such plunger being movable (shiftable) in front of the aperture of the hole-type nozzle. The end of the plunger facing the nozzle has a cone shape with a cone angle of 15° to 90°. The inside face of the nozzle (over the aperture) is adapted to mate with the pointed end of the plunger. The plunger is movable in the apparatus in its longitudinal driection in such a way that the plunger, during the spraying process, is retracted into the spray head, and as soon as the through-put of the disperse system drops to an undesirable measure (level), of goes into a rhythmic sequence for a brief time or after completion of the spraying process, the plunger is shifted in front of the aperture of the hole-type nozzle, the plunger seats in the mating surface indentation in the inner face of the nozzle blocking the aperture.

In one embodiment there can be a protrusion on the end of the cone-shaped point of the plunger that fits into the aperture of the nozzle.

In another embodiment of this invention the apparatus includes a screen insert and a scraping arrangement. The screen insert (means) is attached to the spray head between the inlet for the disperse system and the hole-type nozzle. The scraping arrangement (means) sweeps the surface of the screen insert whenever there is a shifting of the plunger. The screen insert can have a cylindrical form enclosing the lateral surface of the plunger and the scraping arrangement can be a hollow cylinder sweeping the outside periphery of the screen insert.

In a similar embodiment, it is also effective to attach the screen insert to the movement means of the apparatus for the plunger and to attach the scraping arrangement to the spray head.

As used herein, a disperse system is a two-phase system consisting of a dispersion medium and a dispersed phase.

DETAILED DESCRIPTION OF THIS INVENTION

In the drawings:

FIG. I is a longitudinal cross-sectional view of one of the embodiments of the apparatus of this invention.

FIG. II is a longitudinal cross-sectional view of part of another embodiment of the apparatus of this invention.

FIG. III is a longitudinal cross-sectional view of a further embodiment of the apparatus of this invention.

FIG. IV is a longitudinal cross-sectional view of a still further embodiment of the apparatus of this invention.

As shown in FIG. I, plunger 14 is disposed in housing 11, which is equipped with inlet 12 for the disperse system. The end of plunger 14 faces hole-type nozzle 13. Plunger 14 is movably disposed in the longitudinal direction of housing 11 and can be moved in the longitudinal direction manually or effectively by a hydraulic arrangement, mechanical arrangement or electromagnetic arrangement or preferably by pneumatic driving arrangement 15. The movement in one direction of plunger 14 can also be accomplished, for example, by the force of a spring. Plunger 14 is sealed by gasket 16 against driving arrangement 15. (The upper end of plunger 14 should be attached to the end of shaft 22 of pneumatic driving arrangement 15 so that plunger 14 can readily be extracted from blocking aperture 18.) End 17 of plunger 14 facing nozzle 13 has a cone-shaped point. The angle of the cone is 15° to 90°. The inside facing hole-type nozzle 13 over aperture 18 is adapted in its shape to mate with end 17 of plunger 14. Aperture 18 of hole-type nozzle 13 can have the form of a flat jet or a round jet. The diameter of aperture 18 of nozzle 17 depends on the size of the dispersed material present in the disperse system and preferably is 0.3 mm to 4 mm.

The disperse system may be fed into the spraying apparatus by any suitable pumping arrangement (examples of such are well known to the art). The pressures used thereby can be up to 150 atm., preferably 20 to 30 atm.

The point or end of cone 17 of plunger 14, as shown in FIG. II, can be provided with adapting piece 19 which fits precisely through aperture 20 of hole-type nozzle 21.

The apparatus of the invention is used for spraying of disperse systems, preferably suspensions containing graphite having a top grain size of 25 to 150$\mu$ as the dispersed material and a liquid as the dispersion agent (medium).

Such suspensions, especially the ones which also contain, beside the dispersion agent, stabilizers, auxiliary dispersing agents and polymers, for example, according to the German OS No. 2,450,817, could only be very poorly sprayed with known apparatuses. The relatively coarse grain graphite on the one hand and the polymers, which are inclined to resinification in the aperture of the nozzle, on the other hand, continuously decreases the through-put in known spraying apparatuses and finally clogging occurs.

With the apparatus of this invention, coarse-grained substances and polymers inclined to resinification, can be sprayed without any decrease in through-put. As soon as the through-put of the disperse system declines to an undesirable measure or in a rhythmic sequence, the plunger will be forced (pressured) for a short time out of the spray head into the hole-type nozzle, as a result of which any possible particles plugging up the hole-type nozzle are forced through said nozzle. After retraction of the plunger, the hole-type nozzle is again fully effective. For such suspensions, preferably hole-type nozzles having nozzle openings of 0.5 to 1.0 mm are used.

The spraying arrangement can also be used for other known disperse systems which, for example, are inclined to resinification in the case of any contact with air or which, on the basis of the particle size of the dispersing material, could hitherto before only be sprayed with difficulty using known apparatuses or not at all.

The plunger can be controlled in such a way that the end thereof, after shutting off the supply of the disperse system, is forced into the aperture of the hole-type nozzle and simultaneously cleans and safely locks (blocks) it. In the case of a renewed supply of the disperse system, the plunger can again be pulled back into the spray head and the renewed supply sprayed.

In FIG. III, plunger 104 is movably disposed in housing 101, which is equipped with inlet 102 for the disperse system and on the end of which is hole-type nozzle 103. Plunger 104 is disposed movable in the longitudinal direction and is moved, for example, pneumatically by piston 105. End segment 117 of plunger 104 fits in aperture 116. Screen insert 106 effectively has a cylindrical form enclosing the lateral surfaces of plunger 104. Screen insert 106 may be attached to piston 105. (Plunger 104 should be attached, directly or indirectly to the end of shaft 115 of piston 105 so that plunger 104 can be readily extracted from blocking aperture 116 of nozzle 103.) Scraping arrangement 107 is effectively a hollow cylinder sweeping the outside periphery of the screen insert and can be attached to housing 101.

Whenever disperse systems, especially suspensions, are sprayed with the apparatus of this invention, any possibly entrained (separated or precipitated) solid particles are held back at screen insert 106.

Whenever plunger 104 is moved by piston 105 in the direction of hole-type nozzle 103, screen insert 106 is pushed into scraping apparatus 107 whereby the surface of screen insert 106 is cleaned of separated (precipitated) particles. The precipitated particles gather in the inside of the spray head. The residue, for example, can be removed from time to time by disassemblying the spray head; but it is also possible, for example to wash out the residue with a partial stream of disperse system from nozzle housing 101 through bore 110.

In FIG. IV, scraping apparatus 111 is made in the form of a grate, whereby two or more parallel scraping bridges 108, which are interconnected by longitudinal bridges 109, sweep the surface of screen 112. Thus it is possible for a short stroke of the piston to sweep a large surface of the screen and thereby clean it of any deposited particles. As shown by way of example in FIG. IV, scraping apparatus 111 is attached to piston 113 and screen insert 112 is attached to housing 114. End segment 118 of plunger 121 fits into aperture 119 of nozzle 120. (Plunger 121 should be attached, directly or indirectly, to the end of shaft 122 of piston 113 so that plunger 121 can be readily extracted from blocking apperture 119 of nozzle 120.)

Effectively screen insert 112 has such a large maximal throughput that the maximal throughput of hole-type nozzle 120 is assured, even in the case of a partial covering of screen inlet 112 with precipitated particles. The passages of screen insert 112 advantageously are in the form of bores; the diameter of such individual bores may be 50 to 90 percent of the diameter of the hole-type nozzle. The total surface area of the openings of the bores of screen insert 112 is to be 10 to 600 times the surface area of the opening of the aperture 119 of hole-type nozzle 120.

With the apparatus of the invention it is possible to spray even disperse systems, especially suspensions which, for example, have irregular grain fractions or contain impurities in the form of solid bodies, such as, metal chips, wood, sand or pieces of plastic.

The end of the plunger in FIGS. III and IV is not cone shaped, but readily can be as in the FIGS. I and II (the end of the plunger not referring to protrusions 117 and 118).

What is claimed is:

1. An apparatus for the spraying of a disperse system and which has a spray head with a hole-type nozzle, characterized by a plunger, which is disposed inside the spray head and is shiftable in front of the aperture of said hole-type nozzle, a screen insert, which is disposed in said spray head between the inlet for said disperse system and said hole-type nozzle, and scraping means for a screen insert, which is disposed between the inlet for said disperse system and said screen insert in such a manner that said scraping means, upon movement of said plunger, sweeps the screen surface of said screen insert, means for moving said plunger, and an outlet located between said inlet for said disperse system and said screen insert, which serves as an exit for material sweep off of said screen surface.

2. An apparatus as claimed in claim 1 wherein said screen insert has a cylindrical form enclosing the lateral surface of said plunger and said scraping means is a hollow cylinder which sweeps the outside surface of said screen insert.

3. An apparatus as claimed in claim 1 wherein said screen insert is attached to the means for moving said plunger and said scraping means is attached to said spray head.

4. An apparatus as claimed in claim 1 wherein said spraying a disperse system which is a suspension containing graphite having an upper grain size of 125 to 150$\mu$ as the dispersed material and a liquid as the dispersion medium.

* * * * *